US011378082B2

(12) United States Patent
Diekmann et al.

(10) Patent No.: US 11,378,082 B2
(45) Date of Patent: Jul. 5, 2022

(54) FLUID PUMP HAVING AN INTERNAL BEARING COLLAR AND METHOD FOR ASSEMBLING THE FLUID PUMP

(71) Applicant: Mahle International GmbH, Stuttgart (DE)

(72) Inventors: Johannes Diekmann, Schorndorf (DE); Andrej Rul, Stuttgart (DE); Benjamin Weimann, Stuttgart (DE)

(73) Assignee: Mahle International GmbH

( * ) Notice: Subject to any disclaimer, the term of this patent is extended or adjusted under 35 U.S.C. 154(b) by 266 days.

(21) Appl. No.: 16/114,193

(22) Filed: Aug. 27, 2018

(65) Prior Publication Data

US 2019/0063440 A1 Feb. 28, 2019
US 2020/0191149 A9 Jun. 18, 2020

(30) Foreign Application Priority Data

Aug. 28, 2017 (DE) ..... 102017214998.1

(51) Int. Cl.
*F04D 13/06* (2006.01)
*F04D 29/42* (2006.01)
(Continued)

(52) U.S. Cl.
CPC ..... *F04D 13/0633* (2013.01); *F04D 13/0613* (2013.01); *F04D 13/0626* (2013.01);
(Continued)

(58) Field of Classification Search
CPC ... F04D 13/0686; F04D 13/0613; F04D 29/62
See application file for complete search history.

(56) References Cited

U.S. PATENT DOCUMENTS 3,220,350 A * 11/1965 White ..... F04D 29/0416 417/357
4,508,957 A * 4/1985 Rocchitelli ..... B60S 1/481 392/479
(Continued)

FOREIGN PATENT DOCUMENTS

CN 106151055 A 11/2016
DE 1956632 A1 5/1971
(Continued)

OTHER PUBLICATIONS

English abstract for DE-2744856.
(Continued)

*Primary Examiner* — Nathan C Zollinger
*Assistant Examiner* — Timothy P Solak
(74) *Attorney, Agent, or Firm* — Fishman Stewart PLLC

(57) ABSTRACT

An electric fluid pump may include a pump housing and an electric motor. A rotor may have a rotor shaft and may be mounted in a rotatable manner in a stator body, which may have a stator embedded at least regionally therein. The pump housing may be subdivided into a dry and a wet region containing the rotor. The rotor shaft may be mounted on a bottom side and may be connected to a pump impeller on a pump-impeller side, facing away from the bottom side. The pump housing may have, on the pump-impeller side, an aperture out of which the rotor shaft may project. The pump housing may have an internal first bearing collar arranged around the aperture, the dry region located radially around the first bearing collar, and an outside diameter of the first bearing collar being less than a maximum diameter of the rotor.

20 Claims, 4 Drawing Sheets

(51) Int. Cl.

| | |
|---|---|
| ***F04D 29/58*** | (2006.01) |
| ***F04D 29/02*** | (2006.01) |
| ***F04D 29/62*** | (2006.01) |
| *F04D 29/60* | (2006.01) |

(52) U.S. Cl.

CPC ..... *F04D 13/0686* (2013.01); *F04D 29/026* (2013.01); *F04D 29/426* (2013.01); *F04D 29/588* (2013.01); *F04D 29/628* (2013.01); *F04D 13/0653* (2013.01); *F04D 29/586* (2013.01); *F04D 29/5813* (2013.01); *F04D 29/605* (2013.01)

(56) References Cited

U.S. PATENT DOCUMENTS 5,009,578 A * 4/1991 Hyland ..... F04D 13/0613 417/365
5,785,013 A * 7/1998 Sinn ..... F04D 29/5813 123/41.44
9,366,259 B2 6/2016 Binder et al.
2004/0031141 A1* 2/2004 Miller ..... H02K 5/08 29/596
2004/0062664 A1 4/2004 Weigold et al.
2005/0099773 A1* 5/2005 Bernarding ..... F04D 29/588 361/699
2006/0057005 A1* 3/2006 Williams ..... F04D 29/426 417/423.14
2010/0118503 A1* 5/2010 Kellermann ..... H05K 3/284 361/772
2014/0017073 A1* 1/2014 Muizelaar ..... F04D 29/426 415/177

FOREIGN PATENT DOCUMENTS

DE 2744856 A1 4/1979
DE 102012222358 A1 6/2014

OTHER PUBLICATIONS

Chinese Office Action dated Jul. 28, 2020 for copending Chinese Application No. 201810986100.4 (with English translation).
English abstract for CN106151055.

* cited by examiner

FLUID PUMP HAVING AN INTERNAL BEARING COLLAR AND METHOD FOR ASSEMBLING THE FLUID PUMP

CROSS REFERENCE TO RELATED TO APPLICATIONS

This application claims priority to German Patent Application No. DE-102017214998.1, filed Aug. 28, 2017, which is hereby incorporated by reference in its entirety.

TECHNICAL FIELD

The invention relates to an electric fluid pump. The invention also relates to a method for assembling the fluid pump.

BACKGROUND

Electric fluid pumps are known for example from DE 10 2012 222 358 A1 and are used to deliver a fluid. In this case, a fluid pump usually has a housing and an electric motor arranged in the housing. In this case, the electric motor comprises a stator and a rotor mounted in a rotatable manner in the stator. In order to protect the stator from the fluid to be pumped, the stator is arranged in a split case or else embedded in a stator body. The stator body then usually also forms the housing of the fluid pump. In this way, the fluid pump is divided into two regions. In a wet region located within the stator, a fluid to be pumped flows and at the same time cools the rotor. In a dry region located around the stator body, a control board is fixed—usually with an opening around the stator body.

In order to satisfy the increasing performance and installation-space requirements, the diameter of the electric motor—both of the rotor and of the stator body—is constantly being adapted. Consequently, the wet region located around the rotor is changed and there is increasingly little space available in the dry space for the control board. Furthermore, the control board has to be adapted appropriately upon any modification of the electric motor.

Therefore, the object of the invention is to specify, for an electric fluid pump of the type in question, an improved or at least alternative embodiment, in which a dry region is enlarged. A further object of the invention is to also provide, for the improved or at least alternatively configured fluid pump, a corresponding assembly method.

This object is achieved according to the invention by the subject matter of the independent claims. Advantageous embodiments are the subject matter of the dependent claims.

SUMMARY

The present invention is based on the general concept of at least regionally radially limiting a wet region in an electric fluid pump and as a result at least regionally enlarging a dry region. In this case, the electric fluid pump has a pump housing and an electric motor arranged in the pump housing. A rotor of the electric motor has a rotor shaft and is mounted in a rotatable manner in a stator body, which has a stator embedded at least regionally. In this case, the pump housing is subdivided into the dry region and into the wet region, which contains the rotor. The rotor shaft is mounted on a bottom side in the pump housing and is connected in terms of drive to a pump impeller on a pump-impeller side, facing away from the bottom side, of the pump housing. The pump housing additionally has, on the pump-impeller side, an aperture out of which the rotor shaft projects. According to the invention, the pump housing has an internal first bearing collar arranged around the aperture. In this case, the dry region is located radially around the first bearing collar, and an outside diameter of the bearing collar is less than a maximum diameter of the rotor.

In the fluid pump according to the invention, the stator is embedded in the stator body and radially separates, around the rotor shaft, the dry region from the wet region. The stator body encloses the stator with a plurality of coils and further electrical components and in this way protects them from the fluid to be pumped in the wet region. The stator body can consist for example of an electrically non-conductive plastic and be produced by single stage or multistage plastic overmoulding. According to the invention, the rotor shaft is mounted on the bottom side in the pump housing on one side and projects out of the aperture on the pump-impeller side of the pump housing. Located according to the invention around the aperture is the first bearing collar, which receives the rotor shaft on the other side. The dry region is in this case located radially around the first bearing collar. The outside diameter of the bearing collar is smaller than the maximum diameter of the rotor, and so the dry region around the rotor shaft is advantageously enlarged. Consequently, in the fluid pump according to the invention, more installation space is available for the electronic components in the dry region and the fluid pump can furthermore be configured in a more compact manner. The electronic components can comprise for example a control board, which can be arranged around the first bearing collar and for which more installation space is available than usual in the fluid pump according to the invention.

Advantageously, provision can be made for the bearing collar to be formed integrally on the pump housing, and a first shaft bearing receiving the rotor shaft to be arranged in a manner butting against an inner face of the first bearing collar. The first shaft bearing receives the rotor shaft and the rotor shaft is mounted in the pump housing on both sides. The fluid pump thus forms an individual module and is advantageously connectable to pump impellers and pump housings of different designs. The diameter of the aperture in the pump housing is furthermore determined by the rotor shaft and the first shaft bearing, and the outside diameter of the first bearing collar can be much smaller than the maximum diameter of the rotor. Furthermore, the outside diameter of the first bearing collar is independent of the maximum diameter of the rotor and of an inside diameter of the stator body. Compared with conventional fluid pumps, in the fluid pump according to the invention, a control board of identical design can be installed in fluid pumps with varying rotors and stator bodies. Advantageously, the production costs and the production effort can be considerably reduced as a result.

In an advantageous development of the fluid pump according to the invention, provision is made for at least one fluid duct to be arranged in the first bearing collar, said fluid duct leading axially towards the outside from the wet region of the pump housing. The rotor shaft is connectable in terms of drive to the pump impeller on the pump-impeller side of the pump housing. The pump impeller is then arranged outside the pump housing on the pump-impeller side, such that a pump wet region around the pump impeller with the fluid to be pumped and the wet region of the pump housing are axially separated by the pump housing. The at least one fluid duct expediently leads from the wet region of the pump housing to the pump-impeller wet region, and the rotor can be flowed around and cooled by the fluid to be pumped.

Advantageously, provision can be made for the pump housing to have an at least regionally cylindrical housing bottom part encasing the stator body, wherein a diameter of the cylindrical housing bottom part is greater than a spacing between the pump-impeller side and the bottom side of the pump housing. By way of the encasing housing bottom side of the pump housing, the heat generated in the stator body can advantageously be emitted to the outside. To this end, the housing bottom part of the pump housing can consist of a thermally conductive material—for example of aluminium—and be arranged in a manner butting against the stator body. Furthermore, it is also possible for the stator body to consist of a thermally conductive material—for example of a thermally conductive plastic. Thus, it is possible for example for the stator body to consist of a polyamide—also filled with fillers such as glass fibres, for example. The polyamide has a volume resistivity of between $10^{10}$ and $10^{13}$ Ω*m and a thermal conductivity of between 0.3 and 0.4 W/(m*K), and can be used for fluid pumps of a low performance class with low currents. The stator body made of the polyamide is cost-effective, with the result that the production costs for the fluid pump can advantageously be reduced. Alternatively, the plastic of the stator body can have a volume resistivity greater than $10^{10}$ Ω*m and a thermal conductivity greater than 6 W/(m*K). The thermally conductive plastic having these properties can be used in particular for fluid pumps of a high performance class with high currents. In order to protect the plastic of the stator body from the fluid to be pumped, the stator body can also have a protective layer made of a fluid resistant plastic. The fluid resistant plastic can be for example a polypropylene sulfide—also filled with fillers such as glass fibres, for example. Polypropylene sulfide has a volume resistivity of between $10^{10}$ and $10^{15}$ Ω*m and a thermal conductivity of between 0.3 and 0.4 W/(m*K), and can protect the stator body from the fluid to be pumped. The protective layer can amount to a few micrometres to a few millimetres, such that the properties of the protective layer have only a slight effect on the heat-conducting properties of the stator body.

Advantageously, the size of the dry region in the fluid pump according to the invention is independent of the dimensions of the rotor and of the stator body, such that even at a given spacing between the pump-impeller side and the bottom side of the pump housing, the performance requirements can be met by an increase in the maximum diameter of the rotor and of the diameter of the stator body. In this way, the fluid pump can be designed in a more compact manner without any adaptation of the electronic components—for example the control board—located in the dry region being necessary.

Advantageously, provision can be made for the stator body to have a fixing collar, which is fixed to an outer face of the first bearing collar. The fixing collar and the first bearing collar thus radially and/or axially separate the dry region from the wet region around the rotor. Furthermore, a seal—for example a sealing ring encircling the first bearing collar—can be arranged between the first bearing collar and the fixing collar of the stator body. The outside diameter of the first bearing collar is independent of the maximum diameter of the rotor and of the diameter of the stator body and can remain constant in differently designed rotors and stator bodies. Accordingly, the dimensions of the fixing collar of the stator body also remain constant and are dependent only on the outside diameter of the first bearing collar.

In one development of the fluid pump according to the invention, provision is advantageously made for a control arrangement, in particular a control board, to be clamped in the pump housing with a fixing opening around the fixing collar of the stator body and perpendicularly to the rotor shaft between the fixing collar and the pump housing. Advantageously, the first bearing collar can pass through the fixing opening of the control arrangement. The dry region is arranged radially around the first bearing collar, and so the control arrangement, in particular the control board, is arranged with the fixing opening around the first bearing collar and the fixing collar in a space-saving manner. In this way, it is also possible for the fluid pump to be designed in a more compact manner. In order in particular to fix the control board around the fixing collar, provision is advantageously made for the stator body to have a plurality of integrally formed clamping ribs, which are formed around the fixing collar and on which the control board is arranged in a supported manner. The clamping ribs further stabilize the fixing collar and damage to the fixing collar can advantageously be avoided. If the control arrangement is formed by the control board and if the control arrangement has an electronic component, the electronic component can be fixed to the control board and pass through the latter at least regionally. The electronic component can be for example a capacitor or some other electronic component to be cooled. In this advantageous way, the fluid pump can be designed in a more compact manner and additionally the electronic component can be cooled better.

Advantageously, provision is furthermore made for a diameter of the fixing opening to be independent of a diameter of the stator body and the maximum diameter of the rotor. The outside diameter of the first bearing collar is determined by the rotor shaft, the shaft bearing and the at least one fluid duct in the first bearing collar. The maximum diameter of the rotor and the inside diameter of the stator body consequently have no effect on the outside diameter of the first bearing collar and of the fixing collar. Advantageously, as a result, the diameter of the fixing opening in the control board is also independent thereof. Advantageously, a control board of identical design can be installed in fluid pumps with varying rotors and stator bodies. Advantageously, the production costs and the production effort can be considerably reduced as a result.

Advantageously, provision can be made for the pump housing to have a second bearing collar, which is formed integrally on the bottom side of the pump housing in a manner facing away from the first bearing collar. In this case, a second shaft bearing that receives the rotor shaft is arranged in a manner butting against an inner face of the second bearing collar. Consequently, the rotor shaft is supported on the pump-impeller side by the first shaft bearing and on the bottom side of the pump housing by the second shaft bearing. The rotor shaft can in this case be connected to the rotor for conjoint rotation and be arranged in the shaft bearing so as to rotate about an axis of rotation. Alternatively, the rotor shaft can be fixed in the shaft bearings and the rotor can be arranged in a rotatable manner on the rotor shaft. Furthermore, the rotor shaft can be either a hollow shaft or a solid shaft. The hollow shaft can advantageously have the fluid to be pumped flowing through it and in this way be cooled.

In order to make it easier to mount the rotor shaft in the second shaft bearing, provision is advantageously made for the second bearing collar to be arranged around a press opening in the pump housing. Thus, when the rotor shaft is being mounted in the second shaft bearing, an opposing pressure can be built up through the press opening such that damage to the pump housing and the rotor shaft is avoided.

In order to seal the pump housing off towards the outside, the press opening is closable with a housing plug following mounting.

In order to allow the fluid to be pumped to be preheated for example in the warm-up phase of a combustion engine, the stator body can be formed from a thermally conductive plastic, preferably by single-stage or multistage plastic overmoulding. In order to preheat the fluid to be pumped, the electric motor can be heated relatively greatly at low speeds by an additional field current. The additional field current can in this case be requested by a controller of the fluid pump even in response to a request by a superordinate controller by means of a heating command. The heating command can be for example an ON command or an OFF command or a setpoint value of an excess heat output to be generated. The controller of the fluid pump in this case applies a voltage that is too high relative to the speed of the electric motor to the stator. The excess power that is generated is converted as heat output into waste heat and emitted to the fluid to be pumped via the stator body. Advantageously, as a result, the efficiency of components preheated by the fluid to be pumped can be increased. Furthermore, costs for additional components that are conventionally used for preheating the fluid to be pumped are dispensed with. Alternatively, the fluid pump can have a heating device, which is fixed in the fluid pump such that the fluid to be pumped is able to flow around it. The heating device preferably has at least one PTC element (PTC: Positive Temperature Coefficient).

Overall, in the fluid pump according to the invention, the dry region is advantageously enlarged and there is more installation space available for the electronic components such as a control board. In the fluid pump according to the invention, it is also possible for the dimensions of the rotor and of the stator body to be adapted to the power requirements without the dry region being reduced in size or modified. Advantageously, the fluid pump according to the invention can also be operated in a modular manner with differently designed pump impellers and pump-impeller housings.

The invention also relates to a method for assembling the above-described fluid pump. According to the invention, a rotor shaft, a rotor and a stator body are arranged in a housing bottom part and a control board is arranged on a fixing collar of the stator body. A housing cover is fixed to the housing bottom part, wherein, as a result, a pump housing is formed. In this case, first of all the rotor shaft, the rotor and the stator body can be arranged in the pump housing and subsequently the control board can be fixed to the fixing collar of the stator body. In this case, the control board can additionally be fastened to the pump housing by way of a suitable connecting means or a suitable connection method—such as by staking, riveting or screwing, for example. Subsequently, the housing cover can be fixed to the housing bottom part for example in a force- or form-fitting manner. Alternatively, first of all the control board can be fixed to the stator body and subsequently the rotor shaft, the rotor and the stator body can be arranged in the housing bottom part. Advantageously, the control board can be interconnected with a stator embedded in the stator body after the control board has been fixed to the fixing collar of the stator body. In this case, the stator can comprise a plurality of coils and further electrical components, which are enclosed by the stator body and in this way are protected from the fluid to be pumped in the wet region. The stator body can be produced for example from a plastic by single-stage or multistage plastic overmoulding.

Provision is also made for a first bearing shaft to be pressed into a first bearing collar in the housing cover before the housing bottom part is closed with the housing cover, and for a second shaft bearing to be pressed into a second bearing collar before the rotor shaft and the rotor are arranged in the housing bottom part. Furthermore, the rotor shaft and the rotor can be arranged in the stator body before the rotor shaft, the rotor and the stator body are arranged in the housing bottom part. In this way, the stator body and the rotor can form a compact and easy-to-handle unit with the rotor shaft and assembly is made easier.

Further important features and advantages of the invention can be found in the dependent claims, in the drawings and in the associated description of the figures with reference to the drawings.

It goes without saying that the features mentioned above and those yet to be explained below are usable not only in the combination specified in each case but also in other combinations or on their own without departing from the scope of the present invention.

Preferred exemplary embodiments of the invention are illustrated in the drawings and described in more detail in the following description, wherein identical reference signs relate to identical or similar or functionally identical components.

BRIEF DESCRIPTION OF THE DRAWINGS

In the drawings, in each case schematically

DETAILED DESCRIPTION

Figure 1:
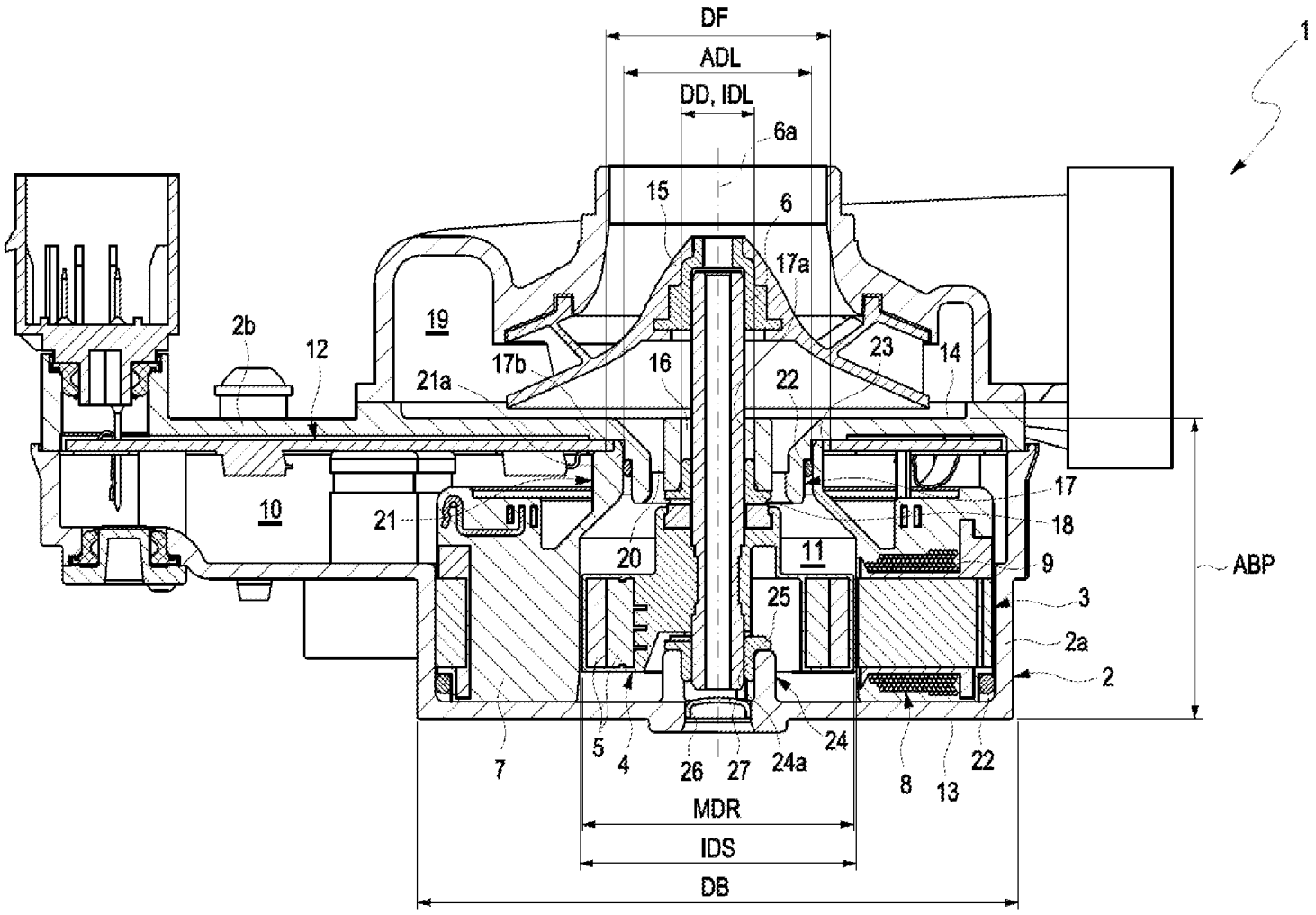
FIG. 1 shows a sectional view of a fluid pump according to the invention with a pump impeller.

FIG. 1 shows a sectional view of an electric fluid pump 1 according to the invention. The fluid pump 1 has a pump housing 2 and an electric motor 3 arranged in the pump housing 2. The pump housing 2 is in this case formed by a housing bottom part 2*a* and a housing cover 2*b*. A rotor 4 having permanent magnets 5 is fixed to a rotor shaft 6 for conjoint rotation and is mounted in a stator body 7 having an embedded stator 8 so as to be rotatable about an axis of rotation 6*a*. The stator 8 has a plurality of coils 9 and further electrical components, which are embedded in the stator body and are surrounded by a material of the stator body 7—for example plastic. In this way, the coils 9 and the further electrical components of the stator 8 can be protected from a fluid to be pumped. The stator body 8 is encased by the regionally cylindrical housing bottom part 2*a*, such that the heat generated in the stator body 7 can be emitted towards the outside. The housing bottom part 2*a* can, to this end, consist for example of aluminium.

The pump housing 2 is subdivided into a dry region 10 and into a wet region 11, wherein a control board 12 is arranged in the dry region 10 and the rotor 4 is arranged in the wet region 11. The rotor shaft 6 is mounted on a bottom side 13 in the pump housing 2 and is connected in terms of drive to a pump impeller 15 on a pump-impeller side 14, facing away from the bottom side 13, of the pump housing 2. In this exemplary embodiment, the rotor shaft 6 is configured in a hollow manner and can be flowed through and cooled by the fluid to be pumped. A spacing ABP of the bottom side 13 from the pump-impeller side 14 of the pump housing 2 is furthermore less than a diameter DB of the pump housing 2. The spacing ABP and the diameter DB are measured on the outside in this exemplary embodiment, but can alternatively also be measured on the inside.

The pump housing 2 has, on the pump-impeller side 14, an aperture 16, out of which the rotor shaft 6 with the pump impeller 15 projects. The pump housing 2 has a first bearing collar 17, which is formed integrally inside the pump housing 2, around the aperture 16. Arranged on an inner face 17*a* of the first bearing collar 17 is a first shaft bearing 18, which receives the rotor shaft 6. A diameter DD of the aperture 16 and an inside diameter IDL of the first bearing collar 17 are thus determined by the rotor shaft 6 and the shaft bearing 18, and are independent of a maximum diameter MDR of the rotor 4 and an inside diameter IDS of the stator body 7.

Furthermore, the dry region 10 is located radially around the first bearing collar 17, and the housing cover 2*b* axially separates the wet region 11 from a pump-impeller wet region 19. In order to connect the wet region 11 and the pump-impeller wet region 19 in a fluid-conducting manner, the first bearing collar 17 has fluid ducts 20, which lead towards the outside, out of the wet region 11 of the pump housing 2, to the pump impeller 15. An outside diameter ADL of the bearing collar 17 is accordingly determined by the inside diameter IDL of the bearing collar 17 and the fluid ducts 20, and is independent of the maximum diameter MDR of the rotor 4 and the inside diameter IDS of the stator body 7. The outside diameter ADL of the bearing collar 17 is less than the maximum diameter MDR of the rotor and the dry region 10 around the rotor shaft 6 is advantageously enlarged.

The stator body 7 furthermore has a fixing collar 21, which butts against an outer face 17*b* of the first bearing collar 17. The fixing collar 21 and the first bearing collar 17 thus separate the dry region 10 from the wet region 11 around the rotor shaft 6. Arranged between the first bearing collar 17 and the fixing collar 21, and between the stator body 7 and the housing bottom part 2*a*, is a respective sealing ring 22, and the dry region 10 is sealed off thereby. The control board 12 is arranged around the fixing collar 21 of the stator body 7 with a fixing opening 23 and is clamped between clamping ribs 21*a* of the fixing collar 21 and the housing cover 2*b*. The dry region 10 is arranged radially around the first bearing collar 17 and the control board 12 with the fixing opening 23 is fixed in the pump housing 2 in a space-saving manner. The outside diameter ADL of the first bearing collar 17 is independent of the maximum diameter MDR of the rotor 4 and of the inside diameter IDS of the stator body 7 and remains constant with differently designed rotors and stator bodies. Accordingly, the dimensions of the fixing collar 21 and a diameter DF of the fixing opening 23 also remain constant. Advantageously, an identically configured control board 12 can be installed in fluid pumps 1 with varying rotors 4 and stator bodies 7 and as a result the product costs and the production effort can be considerably reduced.

The rotor shaft 6 is mounted in the pump housing 2 on the bottom side 13 in a second bearing collar 24. To this end, a second shaft bearing 25 that receives the rotor shaft 6 is fixed to an inner face 24*a* of the second bearing collar 24. The rotor shaft 6 is thus supported on the pump-impeller side 14 by the first shaft bearing 18 and on the bottom side 13 by the second shaft bearing 25. The fluid pump 1 is thus modular and connectable to differently designed pump impellers 15. In order to make it easier to mount the rotor shaft 6 in the second shaft bearing 25, the second bearing collar 24 is formed around a press opening 26 in the pump housing 2. When the rotor shaft 6 is being mounted in the second shaft bearing 25, an opposing pressure can be built up through the press opening 26 and damage to the rotor shaft 6 can be avoided. A housing plug 27 seals the pump housing 2 off towards the outside at the press opening 26.

Overall, in the fluid pump 1 according to the invention, the dry region 10 is enlarged compared with a conventional fluid pump and there is more installation space available for the control board 12. In the fluid pump 1 according to the invention, it is furthermore possible for the dimensions of the rotor 4 and of the stator body 7 to be adapted to the power requirements without changing the control board 12. Advantageously, the fluid pump 1 according to the invention can be operated in a modular manner with differently designed pump impellers 15.

Figure 2:
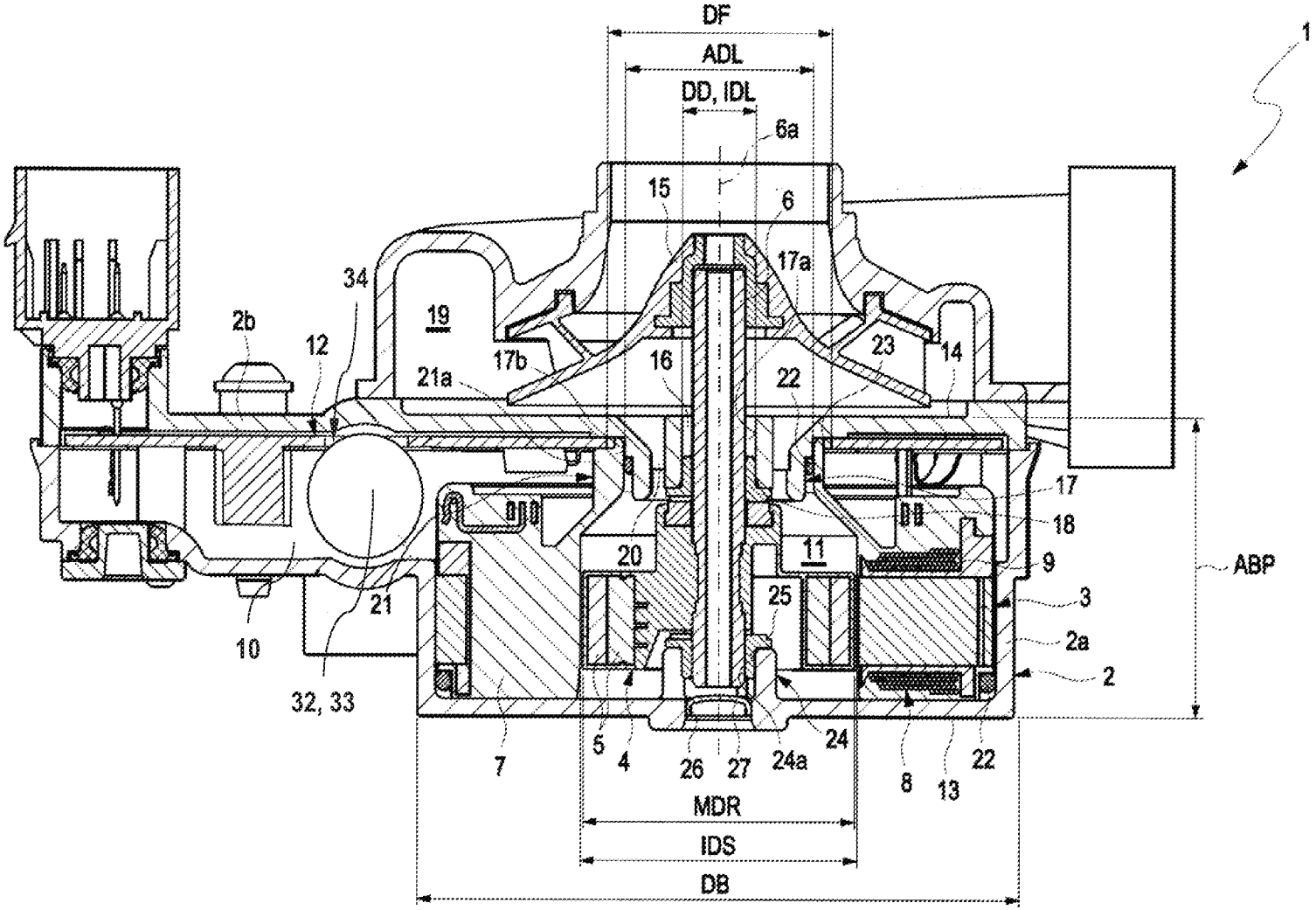
FIG. 2 shows a sectional view of the fluid pump according to the invention with a pump impeller and with an alternatively designed control board.

FIG. 2 shows a sectional view of the fluid pump 1 according to the invention with the alternatively designed control board 12. Here, an electronic component 32—in this case a capacitor 33—is fixed to the control board, said electronic component 32 passing through the control board 12 through a component opening 34. As a result, the electronic component 32 can be cooled better and the fluid pump 1 can be designed in a more compact manner overall. Otherwise, the fluid pump 1 shown here corresponds to the fluid pump in FIG. 1.

Figure 3:
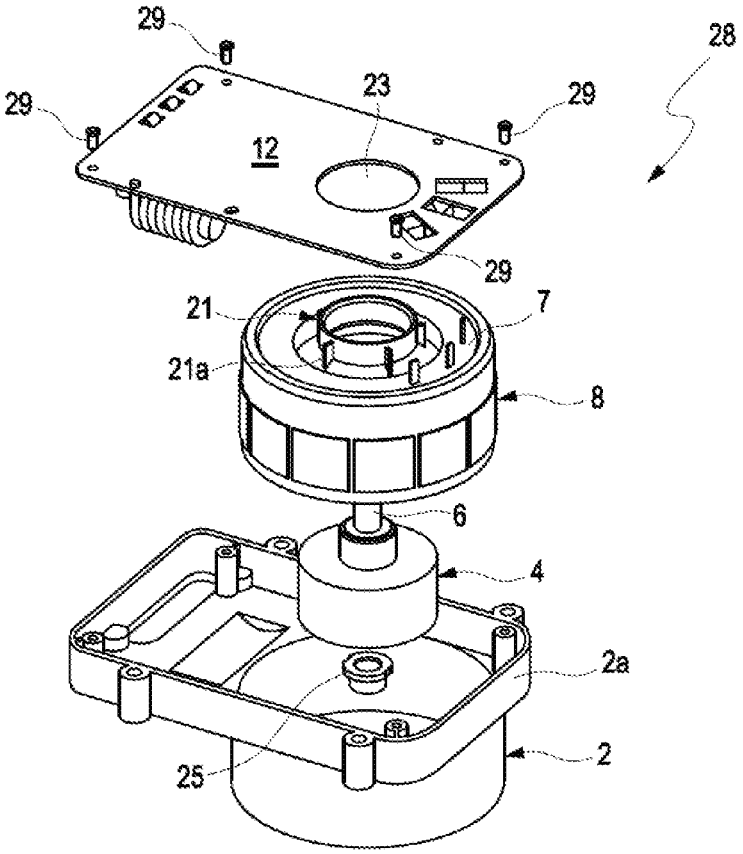
FIGS. 3 to 6 show individual steps in a method according to the invention for assembling the fluid pump shown in FIG. 1.
Figure 4:
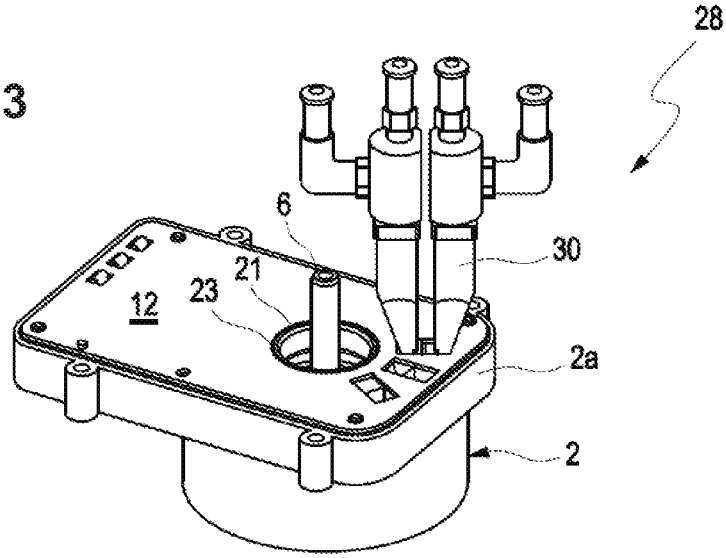
Figure 5:
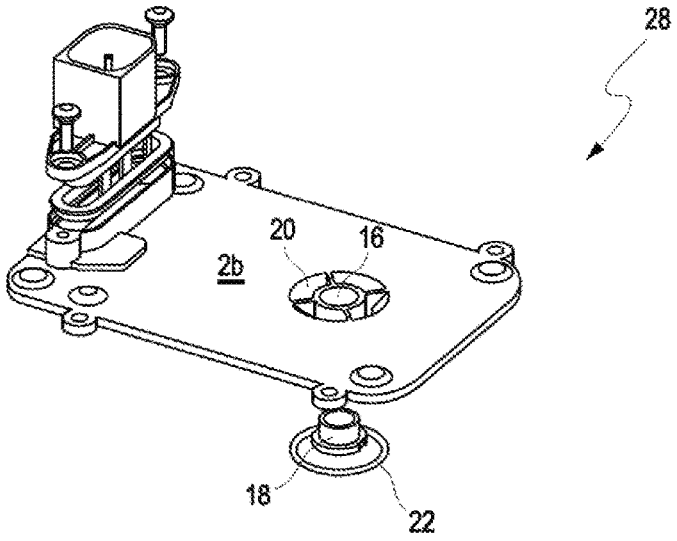
Figure 6:
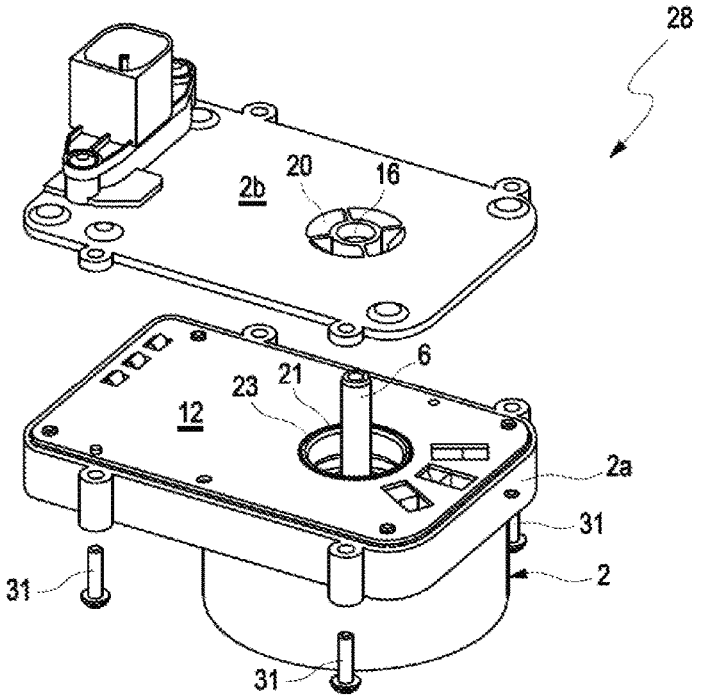

FIG. 3 to FIG. 6 show individual steps in a method 28 according to the invention for assembling the fluid pump 1 shown in FIG. 1. As shown in FIG. 3, first of all the second shaft bearing 25, the rotor 4 with the rotor shaft 6, and the stator body 7 are arranged in the housing bottom part 2*a*. On the stator body 7, the control board 12 is arranged with the fixing opening 23 around the fixing collar 21 and in a manner supported on the clamping ribs 21*a*. The control board 12 is subsequently fixed to the housing bottom part 2*a* with screws 29 or optionally with rivets. In the case of a pump housing 2 made of plastic, staking is also conceivable for fixing the control board 12. As shown in FIG. 4, the control board 12 is subsequently interconnected with the stator 8 by means of a tool 30. In the housing cover 2*b*, the first shaft bearing 18 and the sealing ring are arranged on the first bearing collar 17, as shown in FIG. 5. In FIG. 6, the housing cover 2*b* is subsequently arranged on the housing bottom part 2*a* and fixed by screws 31.

The invention claimed is:

1. An electric fluid pump comprising:

a pump housing; and an electric motor arranged in the pump housing;

wherein a rotor of the electric motor has a rotor shaft and is mounted in a rotatable manner in a stator body, which has a stator embedded in the stator body;

wherein the pump housing is subdivided into a dry region and into a wet region containing the rotor;

wherein the rotor shaft is mounted on a bottom side in the pump housing and is connected in terms of drive to a pump impeller on a pump-impeller side, facing away from the bottom side, of the pump housing;

wherein the pump housing has, on the pump-impeller side, an aperture out of which the rotor shaft projects;

wherein the pump housing has an internal first bearing collar arranged around the aperture, wherein the dry region is located radially around the first bearing collar, and wherein an outside diameter of the first bearing collar is less than a maximum diameter of the rotor;

wherein the stator body has a fixing collar having a fixing collar radially inner facing surface and a seal between a radially outer facing surface of the first bearing collar and the fixing collar radially inner facing surface, the stator body being fixed to the first bearing collar; and wherein the first bearing collar has at least one fluid duct passing axially along a radially inner facing surface of the first bearing collar and radially external to the aperture, which leads toward the outside out of the wet region of the pump housing to the pump impeller.

2. The fluid pump according to claim 1, wherein the first bearing collar is formed integrally on the pump housing, and a first shaft bearing receiving the rotor shaft is arranged in a manner butting against an inner face of the first bearing collar.

3. The fluid pump according to claim 1, wherein at least one fluid duct is arranged in the first bearing collar, said fluid duct leading axially towards an outside from the wet region.

4. The fluid pump according to claim 1, wherein the pump housing has a cylindrical housing bottom part encasing the stator body, wherein a diameter of the cylindrical housing bottom part is greater than a spacing between the bottom side and the pump-impeller side of the pump housing.

5. The fluid pump according to claim 1, further comprising a controller clamped in the pump housing in such a manner that a fixing opening is around the fixing collar of the stator body and perpendicular to the rotor shaft.

6. The fluid pump according to claim 5, wherein the first bearing collar passes through the fixing opening.

7. The fluid pump according to claim 5, wherein a diameter of the fixing opening is independent of an inside diameter of the stator body and the maximum diameter of the rotor.

8. The fluid pump according to claim 5, wherein the stator body has a plurality of integrally formed clamping ribs, which are formed around the fixing collar and on which the controller is arranged in a supported manner.

9. The fluid pump according to claim 5, wherein the controller includes a control board.

10. The fluid pump according to claim 9, wherein the controller has an electronic component fixed to the control board, the electronic component passing through the control board through a component opening in the control board.

11. The fluid pump according to claim 9, wherein the control board is fixed in the pump housing.

12. A fluid pump according to claim 1, wherein the pump housing has a second bearing collar, which is formed integrally on the bottom side of the pump housing in a manner facing away from the first bearing collar, wherein a second shaft bearing receiving the rotor shaft is arranged in a manner butting against an inner face of the second bearing collar.

13. A fluid pump according to claim 12, wherein the second bearing collar is arranged around a press opening in the pump housing, wherein the press opening is closable with a housing plug.

14. The fluid pump according to claim 1, wherein:

the stator body is formed from a thermally conductive plastic such that when a voltage that is too high relative to a speed of the electric motor is applied to the stator, any excess power that is generated is able to be emitted as a heat output to a fluid to be pumped, via the stator body.

15. A fluid pump according to claim 1, wherein the seal is a sealing ring encircling the first bearing collar.

16. A method for assembling a fluid pump, comprising:

arranging a rotor shaft, a rotor and a stator body of an electric motor in a housing bottom part of a pump housing subdivided into a dry region and a wet region;

arranging a controller arranged on a fixing collar of the stator body; and fixing a housing cover to the housing bottom part;

wherein the rotor shaft is mounted on a bottom side in the pump housing and is connected in terms of drive to a pump impeller on a pump-impeller side, facing away from the bottom side, of the pump housing;

wherein the pump housing has, on the pump-impeller side, an aperture out of which the rotor shaft projects;

wherein the pump housing has an internal first bearing collar arranged around the aperture, wherein the dry region is located radially around the first bearing collar, and wherein an outside diameter of the first bearing collar is less than a maximum diameter of the rotor;

wherein the fixing collar includes having a fixing collar radially inner facing surface and a seal between a radially outer facing surface of the first bearing collar and the fixing collar radially inner facing surface, the stator body being fixed to the first bearing collar; and wherein the first bearing collar has at least one fluid duct passing axially along a radially inner facing surface of the first bearing collar and radially external to the aperture, which leads toward the outside out of the wet region of the pump housing to the pump impeller.

17. The method according to claim 16, further comprising:

pressing a first shaft bearing into the first bearing collar in the housing cover before the housing bottom part is closed with the housing cover; and pressing a second shaft bearing into a second bearing collar before the rotor shaft and the rotor are arranged in the housing bottom part.

18. The method according to claim 16, further comprising interconnecting the controller with a stator embedded in the stator body after the controller has been arranged on the fixing collar of the stator body.

19. The method according to claim 16, further comprising arranging the rotor shaft and the rotor in the stator body before arranging the rotor shaft, the rotor and the stator body in the housing bottom part.

20. The method of claim 16, further comprising forming the stator body from a thermally conductive plastic via one of a single-stage plastic overmoulding process or a multi-stage plastic overmoulding process.

* * * * *